United States Patent [19]

Guest et al.

[11] 4,082,200

[45] Apr. 4, 1978

[54] PLASTIC CONTAINER WITH SUPPORT BASE, AND METHOD OF ASSEMBLY

[75] Inventors: Paul Richard Guest, Orange, Conn.; Lawrence D. Ninneman, Toledo, Ohio

[73] Assignee: Owens-Illinois, Inc., Toledo, Ohio

[21] Appl. No.: 700,930

[22] Filed: Jun. 29, 1976

[51] Int. Cl.[2] ..... B65D 23/00

[52] U.S. Cl. ..... 215/1 C; 215/12 R; 29/453

[58] Field of Search ..... 215/12 R, 13 R, 1 C, 215/228; 29/453; 220/17, 69

[56] References Cited

U.S. PATENT DOCUMENTS

| | | | |
|---|---|---|---|
| 1,920,335 | 8/1933 | Wood | 215/228 X |
| 3,285,461 | 11/1966 | Santelli | 220/17 |
| 3,927,782 | 12/1975 | Edwards | 215/1 C X |
| 3,948,404 | 4/1976 | Collins | 215/1 C |

*Primary Examiner*—Donald F. Norton
*Attorney, Agent, or Firm*—Richard D. Heberling

[57] ABSTRACT

This disclosure relates to a plastic container having a separate cup-shaped base telescopically assembled on its bottom to provide stability so that the container can stand upright, and to a method of assembling the base on the container. The container includes a tubular side wall, such as in blow-molded bottles, and a generally convex bottom which is integrally interconnected to the side wall by an arcuate annular heel. A peripheral groove is provided on the outer surface of the container adjacent the heel to receive a radially inwardly directed peripheral bead or lip on the upper end of the base, forming an essentially water-tight seal. One or more longitudinal surface indentations are formed on the outer surface of the container beneath the circumferential groove, to allow the escape of air between the base and the container bottom during their telescopic assembly.

3 Claims, 4 Drawing Figures

FIG. 1
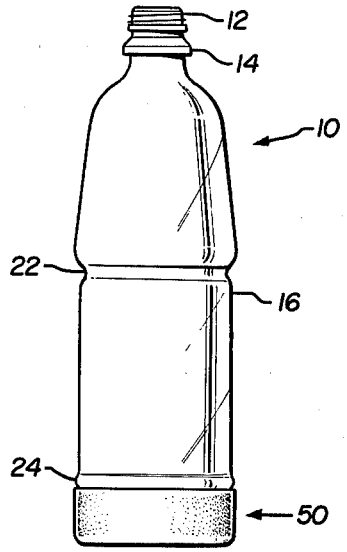
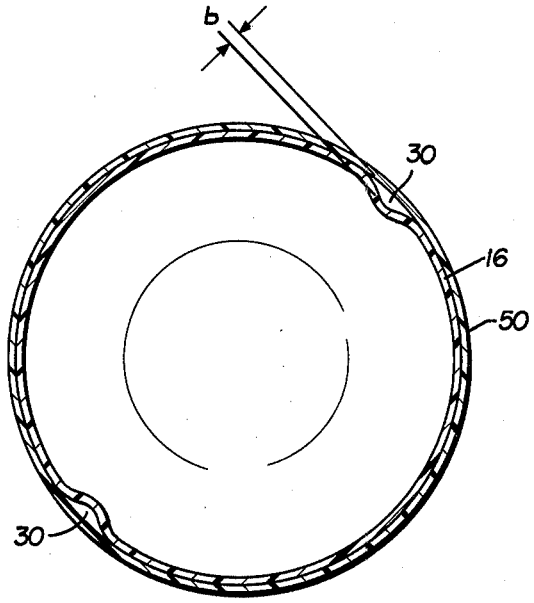
FIG. 3
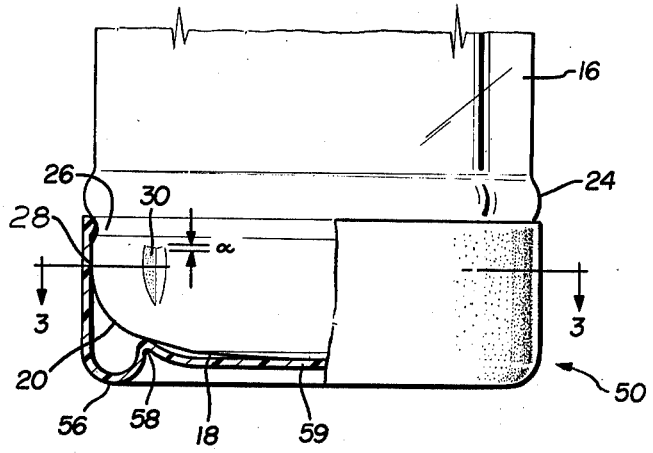
FIG. 2

PLASTIC CONTAINER WITH SUPPORT BASE, AND METHOD OF ASSEMBLY

BACKGROUND OF THE INVENTION

In the formation of bottles and similar containers from thermoplastic materials in blow molding operations, various techniques have been used to form an integral container base having a support surface to enable the container to stand upright in a relatively stable condition. These techniques include, for example, the use of movable mold components, such as pivotal arms with convex mold surfaces, or telescopic sleeves which may be inserted within the blow mold cavity after the blowing operation to convert the convex bottle bottom into a concave shape with a support surface. Most of these techniques inherently include various disadvantages, such as the requirement of additional mold parts and requiring additional operational steps which slow the overall blow molding cycle. Problems have also arisen in prior attempts to form a pressure bottom for a plastic bottle to hold liquids under pressure, such as carbonated beverages, a typical such bottom being similar to the bottom of a glass champagne bottle. This particular design has been undesirable because the concave bottom portion tends to be forced outwardly to a convex configuration under elevated internal pressures. This problem may be solved by increasing the wall thickness of bottle bottom, but this is undesirable from a material usage and cost standpoint. Additionally, the champagne bottom is undesirable because the annular bottom support surface necessarily has a dimension that is smaller than the maximum radial dimension of the bottle wall, and therefore does not provide as much stability as may be desired for maintaining the bottle in a stable upright position.

To overcome these particular problems, separate support bases have been mounted on the bottom of bottles, but these separate members have previously included their own shortcomings. For example, some support bases have been designed for easy assembly, but become removed just as easily during handling. Other bases have been designed for interference fits to alleviate the removal problem, but difficulties have been encountered because a pocket of air between the bottle bottom and the base provides a resistance to their assembly. A first attempt to remedy this particular problem included the provision of an air escape opening in the bottom of the base; however, that opening provided a passageway for liquids to enter the space between the bottle bottom and base, resulting in undesirable bacteria growth.

Accordingly, the prior art does not provide a separate container base which can be easily mounted on the container bottom and provide a water-tight seal.

SUMMARY OF THE INVENTION

These problems are overcome in the present invention by the provision of air escape passageways on the outer surface of a container in the form of surface indentations near the container base. The indentations are located so that air may escape from between the bottle bottom and a separate support base during their assembly, yet so that an essentially water-tight seal may be established between the container and the support base.

In one aspect of the invention, a support base is telescopically mounted on the bottom of the bottle to provide a support surface upon which the bottle can stand in an upright position. The bottle includes a peripheral circumferential groove adjacent its bottom and a plurality of air escape passageways formed on its outer peripheral surface between the bottle bottom and the circumferential groove. The passageways are generally parallel to the longitudinal axis of the bottle and terminate at their upper extremities below the circumferential groove so that an essentially water-tight seal may be formed at the groove. The support base is generally cup-shaped and includes a tubular wall portion telescoped over the bottle bottom, with the tubular wall terminating in an inward radial lip which is received within the circumferential groove on the bottle.

Further in accordance with this invention, the base and bottle are designed to have an interference fit (a) to further reduce the likelihood that the support base will be inadvertently removed from the bottle and (b) so that the bottle and base will rotate together under limited torque as is required in certain bottle handling and labeling operations. In this aspect, the inner diameter of the support base is slightly less than the outer diameter of that portion of the bottle over which it is telescoped, to provide the interference fit.

The method of assembling the bottle and the support base includes aligning the two components and then in a substantially single operation, moving the two components toward each other to telescope the base over the bottle bottom. In accordance with the invention, the assembly step is facilitated by venting air from between the base and the bottom of the bottle by way of the passageways formed on the outer peripheral bottle surface.

Accordingly, the present invention provides the advantages of a support base which is relatively easy to mount on the bottom of a container, which is not easily removed inadvertently, and which provides an essentially water-tight seal with the container. These and other advantages and meritorious features of the invention will be more fully appreciated from the following detailed description and from the claims.

BRIEF DESCRIPTION OF THE DRAWINGS

FIG. 1 is a side elevational view of a bottle and separate support base in accordance with the present invention.

FIG. 2 is a partial cross-sectional view, illustrating the details of the bottle bottom and the support base.

FIG. 3 is a cross-sectional view taken along plane 3—3 as illustrated in FIG. 2, to show the air escape indentations on the outer peripheral surface of the bottle.

DETAILED DESCRIPTION OF THE PREFERRED EMBODIMENTS

Figure 4:
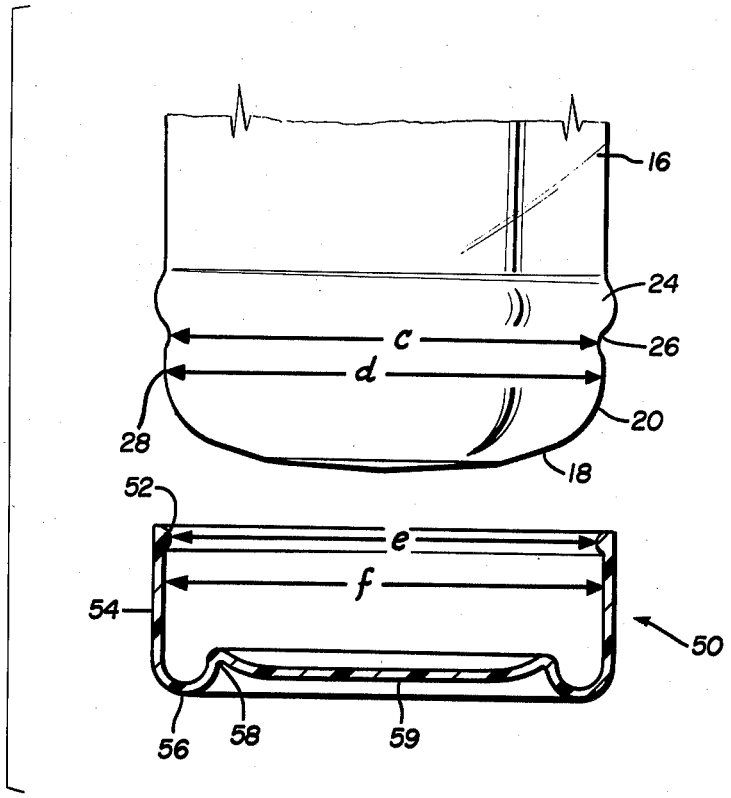
FIG. 4 is a partial cross-sectional view, similar to FIG. 2, but with the bottle and support base disassembled.

Referring more particularly to the drawings, FIG. 1 illustrates a bottle 10 which has been formed by conventional blow molding techniques of suitable plastic materials such as polyethylene terephthalate, polypropylene, polyethylene or polyvinylchloride. A base 50 is mounted on the bottom of the bottle to provide a support upon which the bottle can stand in an upright position. The base may be formed, for example, by injection molding and preferably is formed of a resilient plastic material, such as high density polyethylene.

The bottle itself includes a finish 12, a neck support ledge 14 adjacent the finish, and a tubular side wall or body portion 16. As illustrated in FIGS. 2 and 4, the bottle also includes a generally convex or dome-shaped pressure bottom 18 which is interconnected with the side wall body portion by an arcuate annular heel 20. Secondary features of the illustrated bottle include a peripheral gripping groove 22, shown in FIG. 1, and a peripheral bulbous projection 24, shown in FIGS. 2 and 4, which serves as a "bumper protector" that engages similar portions on other bottles during filling and capping operations.

Turning now more specially to FIG. 2, the configuration of the container bottom 18 is such that it is incapable of supporting the container in a stable upright position, thus requiring the support base 50. To accommodate the retention of the support base 50 on the bottom of the container, a peripheral circumferential groove 26 is provided near the container bottom and is of a reduced outer diameter with respect to most of the other outer surface dimensions of the container body portion.

A radial inward bead or lip 52 is formed on the upper end of the support base 50 and is received within the circumferential groove 26 to provide an essentially water-tight seal. The base further includes a tubular side wall 54, an annular support surface 56, an inverted-V rib 58 which engages and supports the bottom of the container, and a central region 59 which also engages and supports the container bottom.

In order that the base lip 52 and the bottle groove 26 will establish the desired essentially water-tight seal, it is necessary that the dimensions of these two elements be approximately the same. Also, FIG. 2 shows that portion 28 of the bottle has an outer diameter that is slightly greater than the internal diameter of the lip 52, which results in air being trapped between the bottle bottom and the base during their assembly, creating a pocket of air that becomes compressed to resist the assembly of the base 50 on the bottom of the container. To alleviate this problem, the present invention provides one or more surface indentations 30 below the circumferential groove 26 in the region 28 of the bottle between the circumferential groove and the container bottom. These surface indentations are formed on the bottle during the blow molding operation, for example by corresponding mold cavity projections which may be provided by dowel pins in the mold cavity.

As shown in FIG. 2, the surface indentations 30 preferably terminate below the circumferential groove 26 so that the continuous seal between the lip 52 and the circumferential groove is not disturbed. A suitable spacing between the upper extremity of the surface indentation 30 and the circumferential groove is about 0.040 inch, as shown by the dimension "*a*" in FIG. 2. A suitable depth for the surface indentation is also on the order of about 0.040 inch, as shown by the dimension "*b*" in FIG. 3. As will be most apparent from FIG. 3, below groove 26, body 16 includes a peripheral portion the external surface of which (as defined by a plane perpendicular to the axis of the bottle, or body 16) is substantially circular except for segments thereof, e.g. indentations 30, which segments have an external surface whose distance to the bottle axis, from various points on the surface is less than the distance from the axis to the substantial circular external surface of the peripheral portion.

Turning now more specifically to FIG. 4, various dimensions of the components are illustrated by reference letters "*c*", "*d*", "*e*", and "*f*"; "*c*" referring to the outer diameter of the container at the valley of the circumferential groove 26, "*d*" referring to the outer bottle diameter at body portion 28, "*e*" referring to the internal diameter of the base at the inward radial lip 52, and "*f*" referring to the inner diameter of the base at tubular wall 54. As discussed previously, the dimension "*c*" and "*e*" necessarily must be approximately the same to enable the essentially water-tight seal. In one contemplated embodiment, the dimension "*c*" is 2.958 inches and dimension "*e*" is 2.951 inches. Dimensions "*d*" and "*f*" are also interrelated, but may be varied so that "*d*" is either slightly smaller than, the same as, or slightly greater than "*f*" depending upon the desired fit between the bottle and the support base. With the dimensions "*c*" and "*e*" being respectively 2.958 and 2.951 inches and with "*d*" being less than or approximately the same as "*f*" the base 50 may be freely rotated on the container. By making the dimension "*d*" greater than the dimension "*f*", an interference fit is provided at the surface contact in these regions. One such contemplated embodiment, is for the dimension "*d*" to be approximately 3.062 inches and for the dimension "*f*" to be approximately 3.031 inches. This interference fit relationship provides resistance to inadvertent removal of the base from the container and enables the bottle to rotate with the base as may be required during labeling operations where the container is held only by the base 50.

With the components having the dimensions set out in the previous paragraph, the base lip 52 will experience an elastic strain on the order of about three percent as it is forced over the bottle region 28 during the assembly operation. The plastic material at lip 52 is then relaxed as it slips into the circumferential groove 26. Additionally, that portion of tubular wall 54 which is telescoped over bottle region 28 is elastically deformed when placed on the bottom of the container to form the interference fit.

The method of assembling the support base 50 on the bottom of a container includes, first, generally aligning the opened end of the base with the bottom of a container. Then, the two components are moved toward each other, whereupon lip 52 engages the arcuate heel portion 20 and is then slightly stretched as it is forced over bottle region 28. This operation is facilitated due to the surface indentations 30 which allows air between the bottom of the bottle and the support base to be vented, rather than becoming compressed and providing a resistance to the assembly of these two components.

It will be understood that the foregoing disclosure is explanatory in nature rather than limiting. For example, the dimensional relationship between the circumferential groove and the inward radial lip on the support base may be varied within limits to achieve the overall objects of the present invention. Similarly, the longitudinal surface indentations which form the air escape passageways may be modified in configuration and size as may be desirable.

Having therefore completely and fully disclosed our invention, we now Claim:

1. In a container having a finish and an endless side wall, and a base joined to the side wall at the bottom thereof, the base having a rounded bottom portion incapable of supporting the container in a stable upright position, the improvement of a continuous groove formed in said container side wall adjacent said bottom for receiving an essentially correspondingly shaped lip of a separate support member, and a slot formed on the outer periphery of the bottle base for facilitating the escape of air upon the assembly of a separate support member onto the container, with the upper margin of said slot terminating about 0.040 inch beneath the peripheral groove so that the support member lip and the peripheral groove may cooperatively define a continuous, essentially water-tight seal around the periphery of the container side wall.

2. A plastic container having a separate base to provide a support surface upon which the container may be placed for stable upright standing, the container and the base being telescopically assembled by relative axial movement, and wherein the container includes (a) a generally tubular body portion, (b) a bottom surface which is incapable of supporting the container in a stable upright position, (c) a heel portion interconnecting the body of the container and the bottom surface with the heel having a generally arcuate outer surface, and (d) a peripheral groove in the outer surface of the tubular body portion adjacent the heel, and wherein the base is generally cup-shaped and comprised of (a) a bottom support surface, (b) a generally tubular side wall within which the heel and bottom surface of the container are nested, and (c) an inward radial bead on the tubular side wall which seats within the peripheral groove on the container upon telescopic container assembly to provide a continuous, essentially water-tight seal therebetween, and the inner diameter of the base side wall being slightly less than the outer diameter of that portion of the container body between the circumferential groove and the heel prior to the telescopic assembly of the base on the container, to provide an interference fit therebetween and a pair of diametrically opposed indentations formed on the outer surface of the container body, said indentations being axially elongated to extend from just beneath the circumferential groove into the heel, to facilitate the escape of air entrapped between the container and the base due to the interference fit therebetween as the container and the base are telescopically assembled.

3. In a method of telescopically assembling an open-topped cup-shaped base onto the bottom of a container, the steps of:

(1) aligning the open-top of the base with the bottom of the container, the base having a closed bottom and a cantilevered tubular wall portion which includes a circumferential, inward radial lip at its cantilevered end, and the container including a generally dome-shaped bottom, a cylindrical outer wall surface dimensioned for telescopic interference fit within said base wall portion, a peripheral circumferential groove on the outer wall surface adjacent the bottom, and a plurality of longitudinal indentations on the outer wall surface and each projecting longitudinally from the container bottom to a point immediately adjacent the circumferential groove; and (2) in a substantially uninterrupted motion, relatively telescopically moving the container and the base toward each other (a) to insert the container bottom into the base, (b) to vent through one or more of said indentations that air trapped under pressure between the base and the container bottom due to the interference fit between said base and said container, and (c) to sealingly seat the circumferential base lip in the circumferential groove on the container beyond the indentations immediately after the performance of Step 2 (b).

* * * * *